United States Patent [19]

Gamo et al.

[11] Patent Number: 4,589,479

[45] Date of Patent: May 20, 1986

[54] HOT WATER SUPPLY UNIT

[75] Inventors: Takaharu Gamo, Fujiidera; Yoshio Moriwaki, Hirakata; Minoru Tagashira, Chigasaki; Tadayasu Mitsumata, Hirakata, all of Japan

[73] Assignee: Matsushita Electric Industrial Co., Ltd., Osaka, Japan

[21] Appl. No.: 612,784

[22] Filed: May 22, 1984

[30] Foreign Application Priority Data

| | | | |
|---|---|---|---|
| May 23, 1983 | [JP] | Japan | 58-89074 |
| May 27, 1983 | [JP] | Japan | 58-94331 |
| Jul. 12, 1983 | [JP] | Japan | 58-126501 |
| Jul. 13, 1983 | [JP] | Japan | 58-128303 |
| Aug. 22, 1983 | [JP] | Japan | 58-153489 |

[51] Int. Cl.[4] ..... F25B 15/00; F28D 21/00

[52] U.S. Cl. ..... 165/104.12; 62/477; 62/480; 126/263

[58] Field of Search ..... 165/104.12; 62/477, 62/480; 126/263

[56] References Cited

U.S. PATENT DOCUMENTS

| | | | |
|---|---|---|---|
| 4,040,410 | 8/1977 | Libowitz . | |
| 4,085,590 | 4/1978 | Powell et al. | |
| 4,161,211 | 7/1979 | Duffy et al. | |
| 4,165,569 | 8/1979 | Mackay . | |
| 4,185,979 | 1/1980 | Woolley . | |
| 4,330,084 | 5/1982 | Buchner et al. | |
| 4,372,376 | 2/1983 | Nelson et al. | |
| 4,393,924 | 7/1983 | Asami et al. | |
| 4,402,915 | 9/1983 | Nishizaki et al. | |
| 4,409,799 | 10/1983 | Nishizaki et al. | |
| 4,523,635 | 6/1985 | Nishizabi | 165/104.12 |

*Primary Examiner*—Albert W. Davis, Jr.

*Attorney, Agent, or Firm*—Wenderoth, Lind & Ponack

[57] ABSTRACT

The disclosure is directed to an improved hot water supply unit of a heat pump type which employs metal hydrides for less movable parts, simple construction, quiet operation and reduction in cost.

6 Claims, 10 Drawing Figures

HOT WATER SUPPLY UNIT

BACKGROUND OF THE INVENTION

The present invention generally relates to a hot water feeding arrangement which utilizes entry and emission of heat following reversible bonding and dissociation between metal hydrides and hydrogen gas and more particularly, to a heat pump hot water supply unit of energy saving type with a high heat utilizing efficiency which is simple in construction and compact in size, and can be readily employed for any fields utilizing heat in general such as domestic heating or industrial boilers, etc. as well as for hot water feeding.

Conventionally, various hot water supply units which utilize electric power, gas, petroleum or the like as a fuel, have been widely put into practical applications, for example, in the form of a boiler for feeding hot water at about 80° C., a boiler for heating rooms, and a boiler for power generation, etc. according to the end uses and fuels to be employed. Although these supply units are comparatively cheap and convenient to use, a further improvement of the efficiency thereof will particularly be required henceforth in the age where prices of fuel are generally high. In connection with the above, in the prior art techniques, for example, only about 90% of heat imparted by combustion, etc. is utilized as an effective heat amount, without exceeding 100% in any case.

On the other hand, heat pump techniques such as the motor compression type, absorption type, etc. have also made progress for actual utilization, and if such techniques as referred to above are employed, it becomes possible to increase the effective heat amount by obtaining heat from heat sources at comparatively low temperatures such as the atmospheric heat, heat of the earth, etc. and raising the temperature thereof to a comparatively high level, and thus, the above efficiency may be raised over 100% for the actual application. However, since the heat pumps of the motor compression type and engine compression type, or heat pumps of a continuous absorption type as referred to earlier are arranged to circulate a heating medium or absorbing liquid, there are still such disadvantages that pumps and control units employed therein complicate the unit, while noises are undesirably produced in the compression type.

SUMMARY OF THE INVENTION

Accordingly, an essential object of the present invention is to provide a hot water supply unit of a heat pump type which employs metal hydrides with fewer movable parts, simple construction and quiet operation, with substantial elimination of disadvantages inherent in the various known combustion type hot water supply units with a hot water feeding efficiency of about 90%, absorbing type heat pumps of a circulating system which tend to be large in size and high in cost, and motor compression type heat pumps utilizing expensive electric power, etc.

Another important object of the present invention is to provide a hot water supply unit of the above described type, which is so arranged that, by connecting together, through hydrogen transfer pipes, etc. more than one set of metal hydrides composed of a combination of a metal hydride having a relatively low hydrogen equilibrium dissociation pressure and another metal hydride having a relatively high hydrogen equilibrium dissociation pressure at the same temperature, the low pressure side is heated by a heat source such as an external heat source, for example, of a city gas burner and the like for transfer of hydrogen towards the high pressure side, and, through alternate utilization of hydrogen absorbing reaction heat in the above case, sensible heat possessed by the metal hydride and its container at high temperatures in the low pressure side upon subsequent suspension of heating by the external heat source, and hydrogen absorbing reaction heat at the low pressure side upon reverse transfer of hydrogen from the high pressure side towards the low pressure side, etc. hot water may be continuously fed in the actual applications, so as to provide a large hot water feeding capacity at high temperatures.

In accomplishing these and other objects, according to one preferred embodiment of the present invention, there is provided a hot water supply unit which comprises at least one or more pairs of first and second containers containing metal hydrides enclosed therein and having hydrogen equilibrium dissociation pressures different from each other, means for connecting said first and second containers with each other, means for heating said first container in which the metal hydride for the low hydrogen equilibrium dissociation pressure is enclosed, a heating transfer medium circulating passage so provided as to be heat-exchangeable with respect to said first and second containers, and a circulating passage control means provided in said heating transfer medium circulating passage for allowing said heating transfer medium to be alternately directed into said first and second containers. The second container is subjected to heat-exchange with respect to the heating transfer medium during heating of said first container, while the first container is subjected to heat-exchange with respect to said heating transfer medium during suspension of heating of said heating means.

By the arrangement according to the present invention as described above, an improved hot water supply unit has been advantageously provided, with substantial elimination of disadvantages inherent in the conventional hot water supply units.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
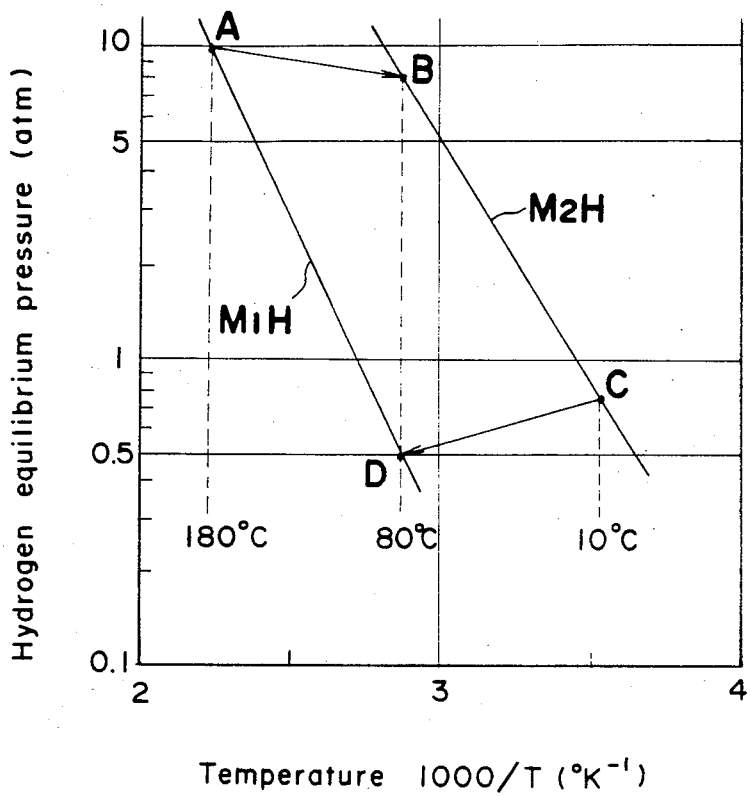
FIG. 1 is a hydrogen equilibrium pressure-temperature diagram showing the operating cycle of metal hydrides for a hot water supply unit according to the present invention.

Before the description of the present invention proceeds, it is to be noted that like parts are designated by like reference numerals throughout the accompanying drawings.

Although it is known that the reaction between a metal hydride and hydrogen gas is reversible, with the state of equilibrium being displaced by an entry or exit of heat or by the heat itself, it has also been found that the metal hydrides have a large reaction speed, with a high heat conductivity, thus making it possible to provide a hot water supply unit having a high hot water supply efficiency as a system, while hot water feeding temperatures, which have been lower than 60° C. in the conventional heat pumps, may be raised even up to 80° C. by a unit utilizing metal hydrides, with a consequent wide field of application of the supply unit.

Referring to FIG. 1, there is shown a hydrogen pressure-temperature diagram showing the cycle of operation of a low equilibrium dissociation pressure side metal hydride $M_1H$ (referred to merely as $M_1H$ hereinafter) and a high equilibrium dissociation pressure side metal hydride $M_2H$ (referred to merely as $M_2H$ hereinafter), which provides a fundamental principle of the present invention. As shown in FIG. 1, heat at a temperature, for example, of 180° C. is intermittently supplied to $M_1H$ by a proper heating means so as to cause $M_1H$ to desorb hydrogen at a point A, and to cause $M_2H$ to absorb this hydrogen at a point B. In the above case, at the point B, heat at a temperature, for example, of 80° C. is produced, which may be utilized for feeding hot water. Subsequently, upon completion of the hydrogen absorbing reaction for $M_2H$, heating of the metal hydride is suspended at this time, and hydrogen is transferred from $M_2H$ to $M_1H$ in the reverse order as in the previous reaction. In the above case, with respect to $M_2H$, the functioning is transferred from the point B to the point C, where an air flow is produced, for example, by a fan to absorb heat from atmospheric air, while, with respect to $M_1H$, the functioning is transferred from the point A to the point D, where heat at a temperature, for example, of 80° C. is generated so as to be utilized for feeding hot water. It is to be noted here that in the case where heat for hot water feeding is obtained from the side of $M_1H$, sensible heat possessed by $M_1H$ and its container is of course also utilized.

By intermittently heating $M_1H$ as described above, the hot water feeding heat at high temperature may be continuously obtained at the points B and D in FIG. 1.

Figure 2:
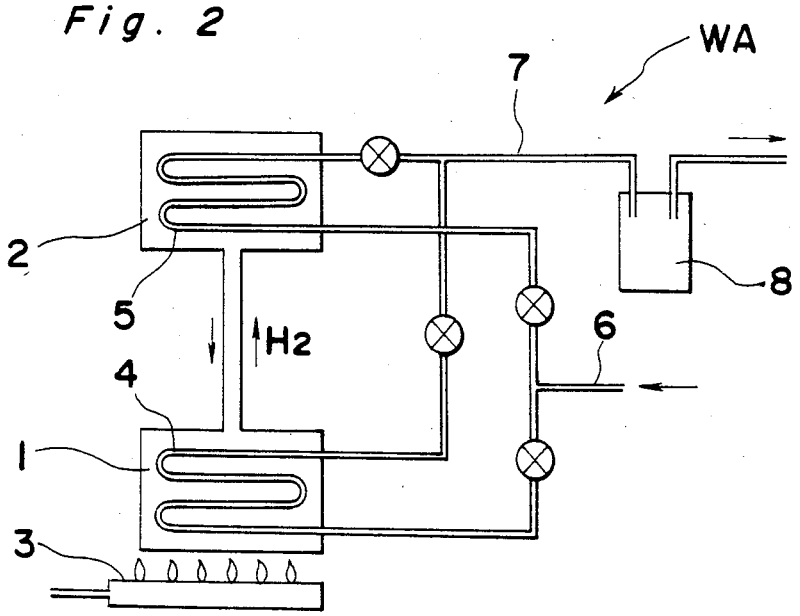
FIG. 2 is a schematic block diagram showing the construction of a hot water supply unit according to one preferred embodiment of the present invention.

Referring also to FIG. 2, there is schematically shown a hot water supply unit WA according to one preferred embodiment of the present invention, which generally includes at least one or more pairs of a low equilibrium dissociation pressure side metal hydride container 1 and a high equilibrium dissociation pressure side metal hydride container 2 coupled to each other through a pipe, heat exchangers 4 and 5 respectively provided in the containers 1 and 2 and connected to each other through pipe lines leading to a city water inlet port 6 and a hot water supply port 7 directed into a storage tank 8, and a burner 3 disposed adjacent to the container 1 as illustrated.

In the above arrangement, for example, 12 kg of metal hydride $LaCo_5$—$H_x$ (with an equilibrium dissociation pressure of 0.76 atm at 80° C.) is accommodated in the low equilibrium dissociation pressure side metal hydride container 1, while 6 kg of metal hydride $LaNi_5$—$H_x$ (with an equilibrium dissociation pressure of 13 atm at 80° C.) is enclosed in the high equilibrium dissociation pressure side metal hydride container 2. The burner 3 provided adjacent to the metal hydride container 1 is intended to heat said container 1 through intermittent combustion, and the heat exchangers 4 and 5 respectively incorporated in the containers 1 and 2 are provided for heat exchanging with respect to water. Thus, water introduced into the unit WA through the inlet port 6 passes through the heat exchanger 5 during combustion of the burner 3 so as to be heated by hydrogen absorbing heat produced in the container 2, while during suspension of combustion of the burner 3, water is heated through the heat exchanger 14 by hydrogen absorbing heat arising from hydrogen gas returning to the container 1 and the metal hydride so as to be respectively supplied outside directly from the hot water supply port 7 or after being once stored in the storage tank 8.

Figure 3:
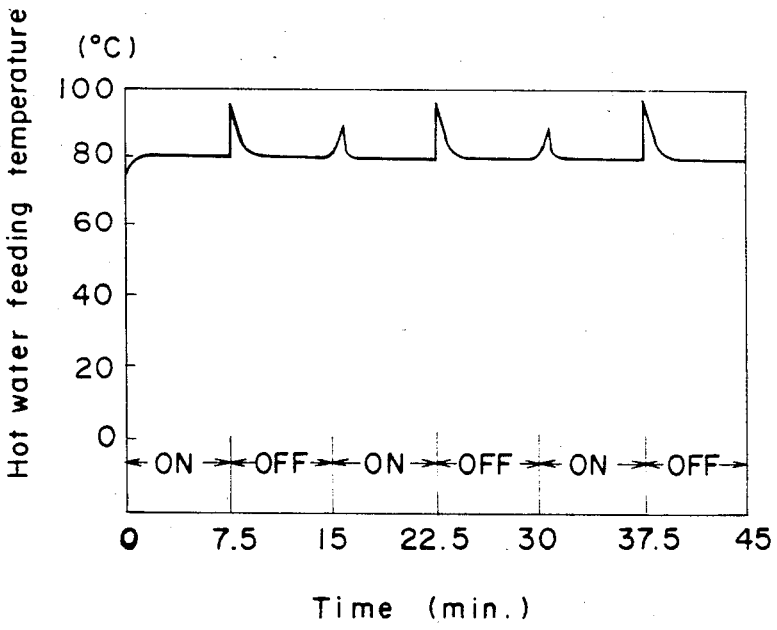
FIG. 3 is a graph showing results of experiments on working characteristics of the hot water supply unit of FIG. 2.

Reference is further made to a graph in FIG. 3 showing results of experiments indicative of working characteristics of the hot water supply unit WA described so far.

In the above experiments, conditions are such that the combustion cycle of the gas burner 3 was set at an interval of 15 minutes so as to find temperatures in which water at 20° C. is raised by a continuous feeding of hot water at a rate of 40 liters per hour. As is seen from the graph of FIG. 3, hot water feeding temperatures are subjected to pulsation according to turning ON and OFF of the burner. The differences between upper and lower temperatures as referred to above are to be determined by the system on the whole based on factors such as the output of the burner, heat capacity of the apparatus, heat exchanging capacity, water flow rate, amounts of metal hydrides, reaction speed, etc. Although the fluctuation in the temperature as described above does not invite any serious problem, hot water at approximately a uniform temperature may be obtained, if the temperature is made equal by providing the storage tank at the end of the supply port 7. In FIG. 2, the storage tank 8 has a capacity of 200 liters and serves to supply hot water at a uniform temperature.

It should be noted here that the temperature of hot water to be obtained is determined by the whole system of the unit based on factors, for example, such as the heat exchanging capacity, etc. besides such factors as the pressure-temperature-composition characteristics of the metal hydrides employed, atmospheric temperatures, temperatures of supplied water and the like.

In the hot water supply unit WA as described so far, the ratio of heat amount which can be utilized for feeding hot water, to the total heat generating amount of the burnt city gas (i.e. the coefficient of performance or COP) becomes about 1.2, and since the coefficient of performance of ordinary gas boilers is about 0.8, it is regarded that energy saving of 1.5 times has been achieved.

Another advantage of the hot water supply unit according to the present invention as described in the foregoing is that the sensible heat of the container 1 containing the metal hydride therein can be effectively utilized for the hot water feeding, thus presenting one of the factors by which the supply unit of the present invention shows the superior coefficient of performance.

Figure 4:
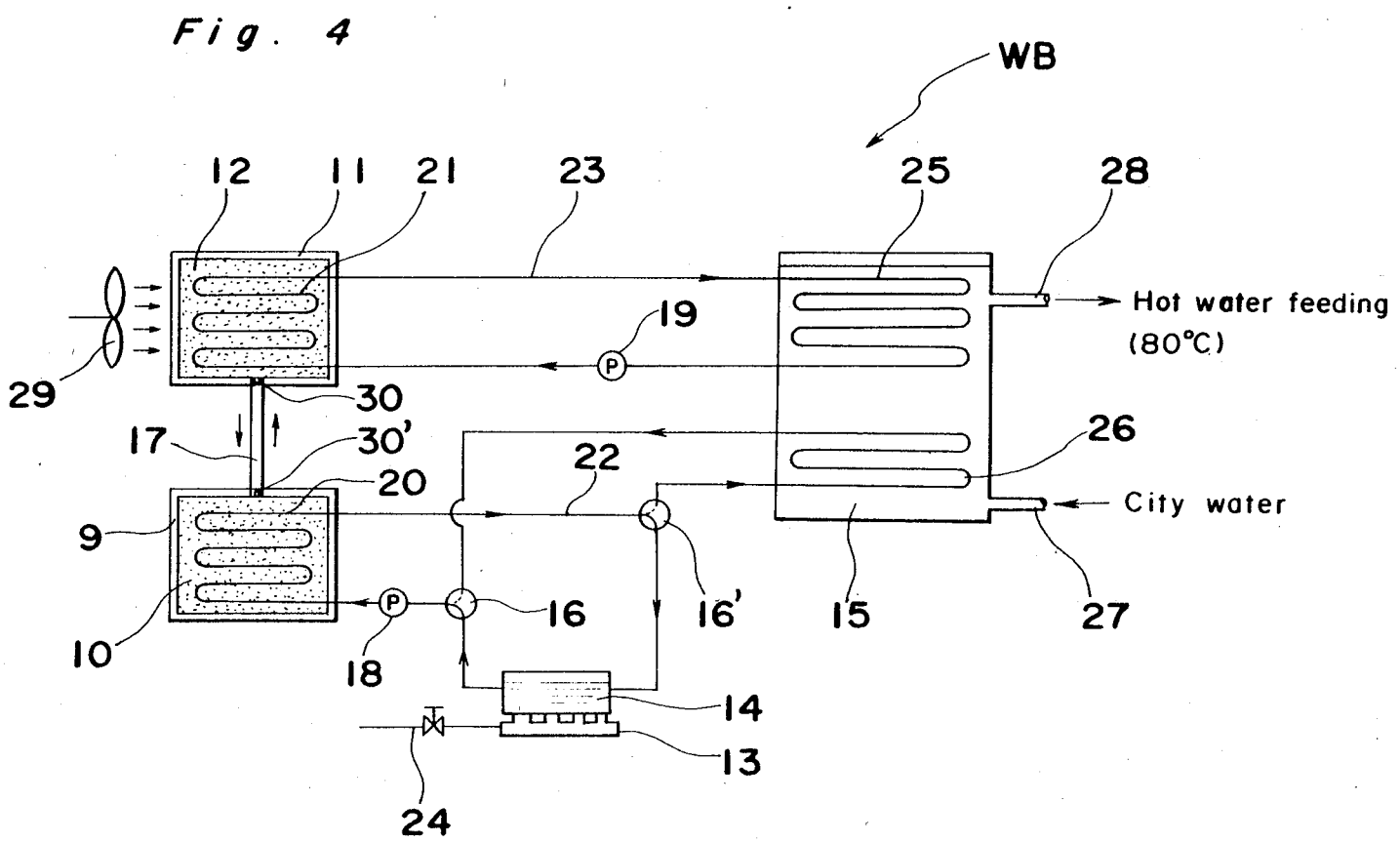
FIG. 4 is a schematic block diagram of a hot water supply unit according to another embodiment of the present invention.

Referring to FIG. 4, there is shown a hot water supply unit WB according to a second embodiment of the present invention, which employs two kinds of metal hydrides, together with a gas burner 13 as an external heat source.

The hot water supply unit WB in FIG. 4 includes a metal hydride container 9 containing therein about 1.8 kg of $Ti_{0.3}Zr_{0.7}Mn_{1.2}Cr_{0.6}Co_{0.2}$ as the low pressure side metal hydride 10 and another metal hydride container 11 containing therein about 3.8 kg of $Ti_{0.6}Zr_{0.4}Mn_{1.2}Cr_{0.4}Co_{0.2}$ as the high pressure side metal hydride 12. Within the containers 9 and 11, heat exchangers 20 and 21 are respectively provided. Through the heat exchanger 20, silicone oil as a high temperature heating transfer medium flows via a line 22, while water as a low temperature heating medium flows through the heat exchanger 21 via a line 23. The flow passage 22 for the silicone oil is adapted to be intermittently changed over between the side for a heating tank 14 and the side for a storage tank 15 by three way change-over valves 16 and 16'. The heating tank 14 is filled with the oil intermittently or continuously heated up to about 180° C. by the burner 13 using city gas supplied via a line 24 as a heat source so as to intermittently heat the low pressure side metal hydride 10 by the oil. In lines leading to the heat exchangers 20 and 21, there are respectively provided heating transfer medium circulating pumps 18 and 19, and the pump 18 is adapted to transport the high temperature heating transfer medium to the heating tank 14 or to the hot water storage tank 15, while the pump 19 is arranged to feed the low temperature heating transfer medium to the tank 15 only when the high pressure metal hydride is effecting the heat generating reaction. Hydrogen in the metal hydride containers 9 and 11 is reversibly transferred through a hydrogen transfer pipe 17 connecting the containers 9 and 11 to each other in correspondence to the fluctuation in temperature of the low pressure side metal hydride. Meanwhile, a fan 29 provided adjacent to the container 11 is adapted to function only when hydrogen moves from the high pressure side metal hydride 12 to the low pressure side metal hydride 10, thereby to suppress lowering of temperature by the endothermic effect of the metal hydride 12. At junctions between opposite ends of the hydrogen transfer pipe 17 and the containers 9 and 11, there are provided porous filters 30 and 30' for preventing the metal hydrides in the powder form from flowing away. In the hot water storage tank 15, heat exchangers 25 and 26 are disposed so as to alternately heat water fed through a city water inlet port 27. The city water thus introduced into the hot water supply unit WB is mainly heated by the two kinds of metal hydrides so as to be hot water at approximately 80° C. and transported by two independent heating medium transfer systems for being stored in the hot water storage tank 15, and is supplied outside through the hot water supply port 28 when required.

Figure 5:
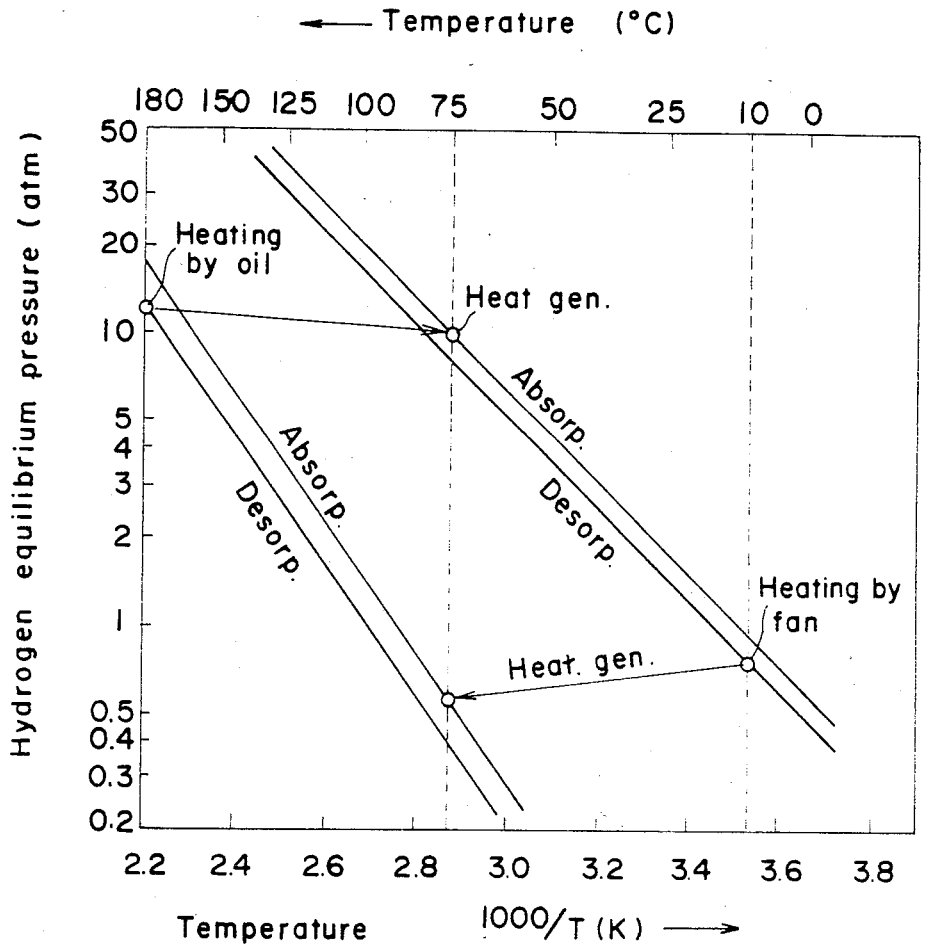
FIG. 5 is a hydrogen equilibrium pressure-temperature diagram showing the operating cycle of metal hydrides for the hot water supply unit in FIG. 4.

In FIG. 5, there is given a hydrogen pressure-temperature diagram explanatory of the operating cycle of the metal hydride in the embodiment of FIG. 4, and showing reactions for continuously obtaining hot water at about 80° C. from the low pressure side metal hydride $M_1H$ and the high pressure side metal hydride $M_2H$ by supplying heat at 180° C. from the burner 13.

Figure 6:
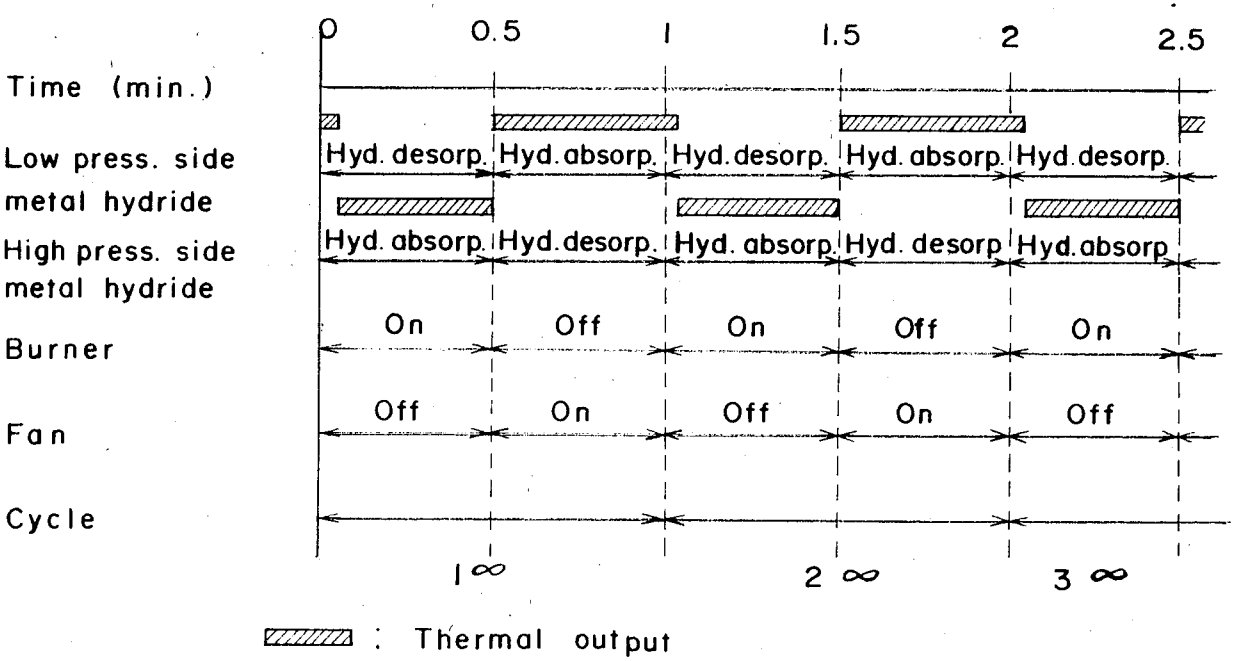
FIG. 6 is a diagram representing modes of operations at respective parts of the hot water supply unit shown in FIG. 4.

Meanwhile, FIG. 6 shows a diagram representing one example of modes of operations at respective parts of the hot water supply unit of FIG. 4. As a result of investigations made into temperatures to which water at 20° C. can be raised by a continuous feeding of hot water at a rate of 180 liters per hour, with the combustion of the gas burner effected at an interval of about 30 seconds, it was found that hot water at about 80° C. could be continuously obtained by alternately changing over between the low pressure metal hydride side and the high pressure metal hydride side as shown in the diagram.

It should be noted here that, in the foregoing embodiments, although each of the two kinds of metal hydrides in total for the low pressure side and high pressure side is accommodated in the corresponding one of the two containers for use, the arrangement may be so modified, for example, that four containers in total are employed for two kinds of metal hydrides at the low pressure side and another two kinds of metal hydrides at the high pressure side so as to effect the hot water feeding operation or that through employment of a third kind of metal hydride having an intermediate hydrogen pressure, the low pressure side and the intermediate pressure side, and the intermediate pressure side and the high pressure side are operated in the similar manner as in the foregoing embodiments employing the two kinds of metal hydrides so as to provide a metal hydride heat pump type hot water supply unit as a highly effective development of the present invention. Furthermore, it is also possible to effect heating of rooms, etc. through direct or indirect utilization of hot water heated in the hot water storage tank.

Figure 7:
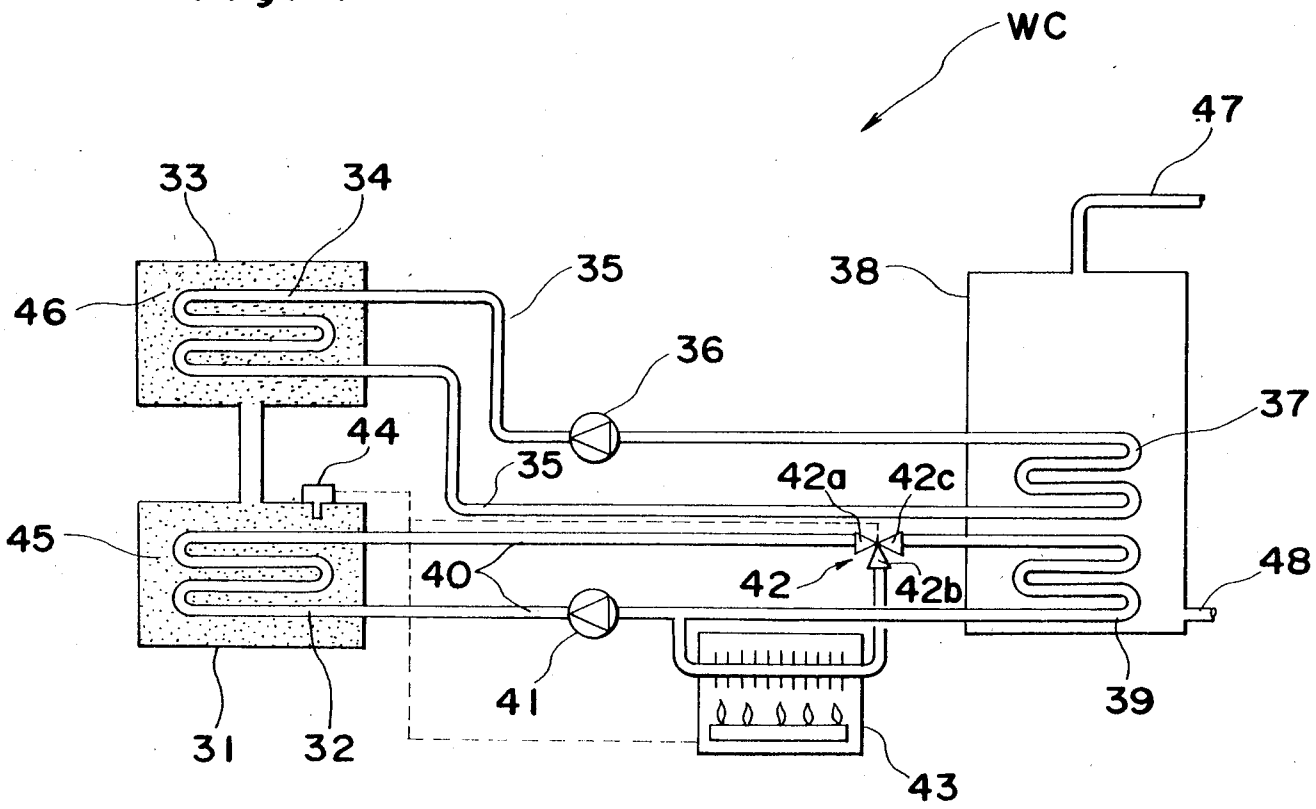
FIG. 7 is a schematic block diagram of a hot water supply unit according to a further embodiment of the present invention.

Referring to FIG. 7, there is shown a hot water supply unit WC according to a third embodiment of the present invention, which also includes at least one or more pairs of a container 31 containing therein a low pressure side metal hydride 45 and another container 33 containing therein a high pressure side metal hydride 46, and heat exchangers 32 and 34 respectively provided in the containers 31 and 33, and coupled with corresponding heat exchangers 37 and 39 disposed in a hot water storage tank 38 through a line 35 provided with a first circulating pump 36, a line 40 provided with a change-over valve 42 and a second circulating pump 41.

By the above arrangement, the heating transfer medium (not particularly shown) is heated by a heating source or burner 43 and fed into the heat exchanger 32 by the second circulating pump 41 through the line 40 so as to heat the metal hydride 45 within the container 31, and is again returned to the portion adjacent to the burner 43 through the line 40 via ports **42*a* and 42*b* of the change-over valve 42. When the hydrogen equilibrium dissociation pressure of the heated metal hydride 45 becomes higher than that of the high pressure metal hydride 46 contained in the container 33, hydrogen gas is transferred from the container 31 into the container 33 so as to be absorbed by the metal hydride 46. In the above case, heat generating action takes place, and the heating transfer medium is heated by the heat exchanger 34 so as to be fed, through the line 35, by the first circulating pump 36 into the heat exchanger 37, and thus, water in the hot water storage tank 38 is heated and stored therein. Meanwhile, the circulating pump 36 is arranged to be operated only when the temperature at the heat exchanger 34 is higher than that around the heat exchanger 37 within the hot water storage tank 38. When the temperature or pressure within the container 31 exceeds a predetermined value, the heat source or burner 43 is shut off via a sensor 44 provided on said container 31, and the port 42*b* of the change-over valve 42 is closed, while the port 42*c* thereof is opened, whereby the heating of the container 31 is stopped, with generation of hydrogen being suspended. Accordingly, since heat generation at the container 33 is stopped, the circulating pump 36 is shut off. In this case, the container 31 is maintained at a high temperature and therefore, the heating transfer medium subjected to heat exchange at the heat exchanger 32 is fed by the circulating pump 41 through the ports 42*a* and 42*c* of the change-over valve 42 into the heat exchanger 39 within the hot water storage tank 38 so as to heat water in said tank 38. Consequently, the container 31 is lowered in its temperature, with a simultaneous reduction in the pressure, and thus, hydrogen gas is produced from the metal hydride 46 within the container 33 and flows into the container 31 so as to be absorbed into the metal hydride 45 for generation of heat, which is conducted to the water in the hot water storage tank 38 through operation of the circulating pump 41 in the similar manner as described earlier. During generation of hydrogen gas from the metal hydride 46, the temperature of the hydride 46 is lowered for absorption of heat outside the container 33. The heat is dissipated when hydrogen gas is absorbed into the metal hydride 45 and stored in the hot water storage tank 38. Water is fed into the tank 38 through a water inlet port 48 provided at a lower portion, and hot water is supplied from a hot water supply port 47 provided at an upper portion of the tank 38**.

Figure 8:
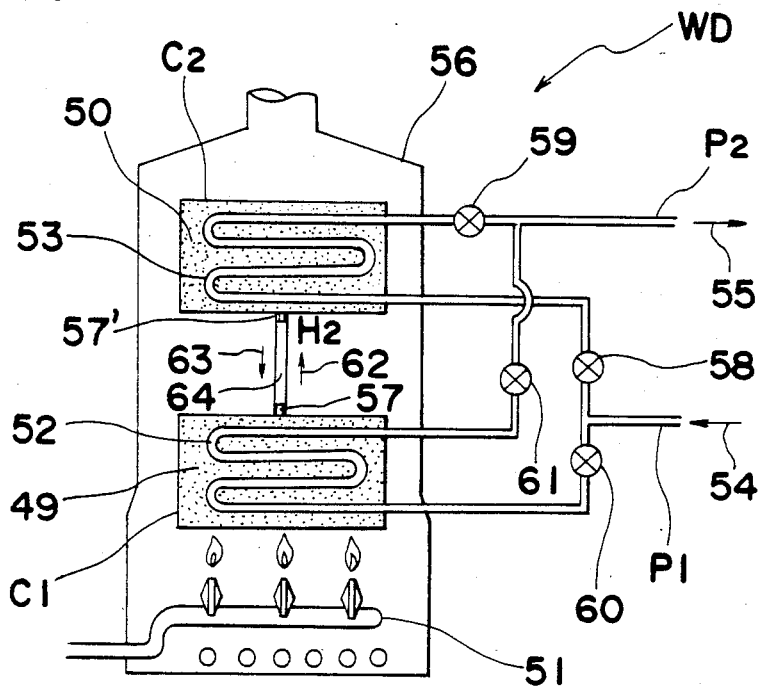
FIG. 8 is a schematic block diagram of a hot water supply unit according to a still further embodiment of the present invention.

Reference is further made to FIG. 8 showing a hot water supply unit WD according to a fourth embodiment of the present invention.

The hot water feeding apparatus WD in FIG. 8 generally includes at least one or more pairs of a low pressure side container C1 containing therein a low pressure side metal hydride 49 and a high pressure side container C2 containing therein a high pressure side metal hydride 50 which are coupled to each other through a hydrogen transfer pipe 64, heat exchangers 52 and 53 respectively provided in the containers C1 and C2 and connected to each other through pipings via valves 58, 59, 60 and 61, an outer wall or stack 56 in which the containers C1 and C2 are housed, and a gas burner 51 disposed within the stack 56 in a position below and adjacent to the container C1.

In the above arrangement, C14 type Ti-Mn alloy hydride having a Laves phase structure is selected for both of the low pressure side and high pressure side metal hydrides, and 7 kg and 13 kg thereof are respectively employed for the low pressure side and the high pressure side so that the hydrogen desorbing pressure of the low pressure side metal hydride 49 at about 180° C. is higher than the hydrogen absorbing pressure of the high pressure side metal hydride 50 at 85° C., with the metal hydride 49 steadily absorbing hydrogen from the high pressure side metal hydride 50. The low pressure side metal hydride 49 is heated up to about 180° C. by the gas burner 51, and when the hydrogen equilibrium dissociation pressure thereof is raised above that at the high pressure side, hydrogen absorbed in the low pressure side metal hydride 49 is moved in a direction indicated by an arrow 62 through the hydrogen transfer pipe 64 and a porous filter 57' into the container C2 so as to be absorbed into the high pressure side metal hydride 50 for generation of absorbing heat thereat. Simultaneously with the above reaction, city water at normal temperature introduced into a city water inlet port P1 in a direction of an arrow 54 is led into the high pressure side metal hydride 50 through the line provided with the valve 58 so as to be subjected to heat exchange with respect to the hydrogen absorbing reaction heat of the high pressure side metal hydride 50 by the heat exchanger 53 and heated into hot water at about 85° C. to flow, in a direction of an arrow 55 through the line having the valve 59, out of a hot water supply port P2. In this case, both the valves 60 and 61 are kept closed.

During combustion, the gas burner 51 first heats the low pressure side metal hydride 49 to consume heat at about 80% for the above heating, while the remaining heat at about 20% contained in the high temperature gas to be exhausted rises through the interior of the stack 56. Although the surplus combustion gas includes a latent heat possessed by water vapor and a sensible heat of the exhaust gas, most of them is the latent heat. The exhaust gas as referred to above, impinges upon the wall of the container C2 at a considerably high temperature, and heats the high pressure side metal hydride 50 so as to raise the temperature thereof by about 10° to 20° C. from a normal temperature. Accordingly, a very quick temperature rise may be expected in the case where hot water is to be obtained by the hydrogen absorbing heat based on the high pressure side metal hydride by the ignition of the gas burner 51, and thus, there is no possibility that the temperature of the hot water falls down to a low level in the vicinity of the normal temperature.

When hydrogen in the low pressure side metal hydride 49 has been completely desorbed, the gas burner 51 is extinguished, and the valves 58 and 59 are closed, with the valves 60 and 61 being opened simultaneously. Then, the city water is introduced into the low pressure side metal hydride 49 through the valve 60, and is heated by the heat exchange with respect to the sensible heat at high temperature possessed by the low pressure side container C1 at the heat exchanger 52. Accordingly, at an initial stage when the gas burner 51 is shut off, the temperature of hot water to be supplied becomes close to 100° C. Upon falling of the temperature for the low pressure side metal hydride 49, with the reversing of the hydrogen equilibrium dissociation pressures between the low pressure side and the high pressure side, hydrogen within the high pressure side metal hydride 50 is moved in a direction indicated by an arrow 63 through the hydrogen transfer pipe 64 and porous filter 57 so as to be absorbed into the low pressure side metal hydride 49 for generation of a reaction heat thereat. Accordingly, thereafter, the city water is steadily heated at a constant temperature of about 85° C. by the reaction heat of the low pressure side metal hydride 49, and flows through the valve 61 in the direction of the arrow 55 to supply the hot water. At this time, the high pressure side metal hydride 50 is cooled by the endothermic action, with a lowering of the equilibrium dissociation pressure so as to act in a direction to reduce the desorbed hydrogen amount, but owing to the heat of the exhaust gas of the gas burner 51 and heat inertia by the inner wall surface of the stack 56, there is no possibility that the temperature falls below the atmospheric temperature. As described so far, according to the present invention, since the high pressure side metal hydride container is adapted to be surrounded by the exhaust gas of the gas burner, the high pressure side metal hydride never loses its heat, although it may obtain heat. In other words, not only loss by the heat radiation can be prevented, but waste heat is advantageously absorbed, and thus, a higher efficiency may be expected. Moreover, since a large amount of insulating material as in the conventional apparatuses is not employed, the above hot water supply unit of the present invention can be made compact in size which is very economical, with favorable temperature rising characteristics in the hot water supply temperature at the ignition of the gas burner. Furthermore, the fan for the high pressure side metal hydride may be dispensed with for a still more compact size and reduction in cost.

Figure 9:
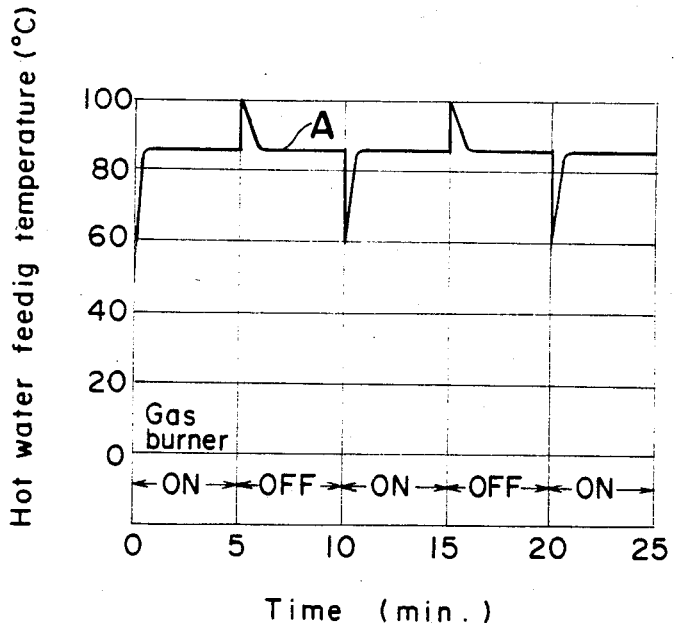
FIG. 9 is a diagram representing working characteristics of the arrangement in FIG. 8.

Reference is also made to FIG. 9 showing one example of results of hot water feeding experiments made on the embodiment shown in FIG. 8. In the experiments, combustion of the gas burner is set at an interval of 5 minutes, and the temperature to which the city water of 20° C. rises was studied through continuous feeding of hot water at a rate of 100 liters per hour, together with the state of temperature variations. As is seen from the diagram of FIG. 9, in spite of the fact that the same kind of metal hydrides are employed by the same amount, the hot water supply unit WD of FIG. 8 could efficiently provide hot water of about 85° C., with favorable rising and falling characteristics in the hot water supply temperatures.

Figure 10:
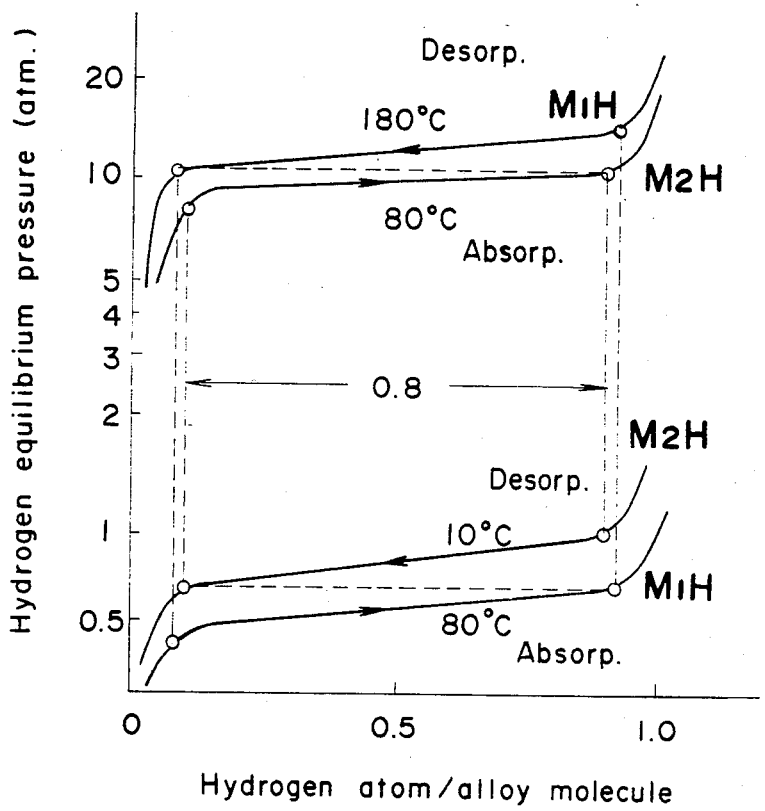
FIG. 10 is a graph representing hydrogen equilibrium dissociation pressure-hydride composition isotherms of the metal hydride with a C14 type Laves phase structure, containing at least Ti and Mn as employed in the present invention.

In FIG. 10, there is shown a hydrogen equilibrium pressure-hydride composition isotherms of the two kinds of metal hydrides for the low pressure side and high pressure side given as one example of the most preferable metal hydrides to be employed for the present invention. In the above case, $Ti_{0.3}Zr_{0.7}Mn_{1.2}Cr_{0.6}Co_{0.2}H_{3.1}$ is employed for the low pressure side metal hydride $M_1H$, while $Ti_{0.6}Zr_{0.4}Mn_{0.4}Cr_{0.4}Cu_{0.2}H_{2.8}$ is adopted for the high pressure side metal hydride $M_2H$.

Now, upon consideration of a case where the low pressure side metal hydride is heated up to 180° C. when the atmospheric temperature is 10° C. for continuously taking out hot water of 80° C., the cycle of operation will be as that shown in FIG. 10. As is seen from FIG. 10, the effectively utilizable hydrogen amount which largely affects the heat generating capacity and required amount of alloy, is about 0.8 for the C14 type Ti-Mn alloy in a ratio of hydrogen atom/alloy atom, as compared with the conventional amount of about 0.35. Accordingly, even when the same amount of metal hydride is employed, heat generating amount as large as about 2.3 times may be obtained, if the C14 type Ti-Mn metal hydride is adopted, with a simultaneous reduction in the price to $\frac{1}{3}$ for the same weight of the metal hydride.

The reasons for the above advantages are such that the material for the present invention has a very small difference between the hydrogen absorbing pressure and hydrogen desorbing pressure, i.e. very small hysteresis, and a favorable flatness of the hydrogen equilibrium pressure, with the combination of the low pressure side $M_1H$ and the high pressure side $M_2H$ being optimum for a heat pump type hot water supply unit.

Moreover, as is seen from FIG. 10, the combination in which the hydrogen equilibrium pressure of the low equilibrium pressure side metal hydride at 80° C. is lower than one atmospheric pressure, and that of the high equilibrium pressure side metal hydride at 80° C. is higher than one atmospheric pressure, is particularly desirable for the supply unit in that the reaction speed is high and sufficient resistance against pressure is provided for the metal hydride containers. The favorable combination as described above may be readily achieved in the case where the material in which the rate of substitution of Zr with respect to Ti contained at the low pressure side is larger than the rate of substitution of Zr with respect to Ti contained at the high pressure side, is selectively employed for the alloy of the present invention.

As described so far, the alloys having the C14 type Laves phase and containing at least Ti and Mn, preferably Ti, Zr and Mn, and more preferably Ti, Zr, Mn and Cr, are provided with almost all characteristics required for the heat pump type hot water supply unit, and therefore, the hot water supply unit employing such alloys is very superior for convenience in handling, and in performance, price, etc.

As is clear from the foregoing description, according to the present invention, the effective heat amount more than the heat amount received from the combustion heat as obtained at a high efficiency by the comparatively simple arrangement, and thus, a hot water supply unit highly effective for energy saving can be advantageously provided. Moreover, since the supply unit of the present invention requires less auxiliary electric power, with fewer movable parts, it becomes possible to provide a hot water supply unit compact in size and quiet in operation.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A hot water supply unit comprising:

at least one first container containing a first metal hydride having a low hydrogen equilibrium dissociation pressure;

at least one second container containing a second metal hydride having a hydrogen equilibrium dissociation pressure which is greater than the hydrogen dissociation pressure of said first metal hydride;

said at least one second container being disposed above said at least one first container;

connection means for passage of hydrogen gas between said at least one first container and said at least one second container;

heating means disposed adjacent and below said at least one first container for heating said at least one first container and indirectly heating said at least one second container through rising heat not consumed by said at least one first container;

stack means for enclosing said heating means, said at least one first container, said connection means and said at least one second container;

circulating means for passing a heat transfer medium in said at least one second container when hydrogen gas is absorbed by said second hydride and for passing said heat transfer medium in said at least one first container when hydrogen gas is absorbed by said first hydride, said circulating means causing said heat transfer medium to heat a supply of water;

whereby said at least one second container is subjected to heat exchange with said heat transfer medium when said at least one first container is heated by said heating means and said at least one first container is subjected to heat exchange with said heat transfer medium during periods when said at least one first container is not heated.

2. The hot water supply unit of claim 1, wherein said heat transfer medium is water to be heated.

3. The hot water supply unit of claim 1, wherein said first hydride and said second hydride comprises an alloy having a C14 type Laves phase structure, said alloy containing Ti and Mn.

4. The hot water supply unit of claim 1, further including a hot water storage tank for storing water heated by said heat transfer medium.

5. The hot water supply unit of claim 1, wherein said first hydride consists of $Ti_{0.3}Zr_{0.7}Mn_{1.2}Cr_{0.6}Co_{0.2}H_{3.1}$ and said second hydride consists of $Ti_{0.6}Zr_{0.4}Mn_{0.4}Cr_{0.4}Cu_{0.2}H_{2.8}$.

6. The hot water supply unit of claim 1, wherein said at least one first container consists of only one first container, said at least one second container consists of only one second container, said heating means consists of only a single heat source, and the hydrides used in said hot water supply unit consists of only said first hydride and said second hydride.

* * * * *